US009335056B1

(12) United States Patent
Lomicka et al.

(10) Patent No.: US 9,335,056 B1
(45) Date of Patent: May 10, 2016

(54) ELECTROMECHANICAL ASSEMBLY FOR OVEN DOOR LATCHING

(71) Applicant: HTI Technology and Industries, Inc., Lavergne, TN (US)

(72) Inventors: Joseph W. Lomicka, Lexington, TN (US); I-Chiang Lin, San Mateo, CA (US)

(73) Assignee: HTI Technology & Industries, Inc., Lavergne, TN (US)

( * ) Notice: Subject to any disclaimer, the term of this patent is extended or adjusted under 35 U.S.C. 154(b) by 140 days.

(21) Appl. No.: 14/173,704

(22) Filed: Feb. 5, 2014

(51) Int. Cl.

| | |
|---|---|
| ***E05C 1/06*** | (2006.01) |
| ***F24C 15/02*** | (2006.01) |
| ***E05B 47/00*** | (2006.01) |
| ***E05C 1/08*** | (2006.01) |
| *E05C 3/04* | (2006.01) |

(52) U.S. Cl.
CPC ..... *F24C 15/022* (2013.01); *E05B 47/0012* (2013.01); *E05C 1/08* (2013.01)

(58) Field of Classification Search
CPC ..... Y10S 292/69
USPC ..... 292/144, 201, DIG. 69
See application file for complete search history.

(56) References Cited

U.S. PATENT DOCUMENTS

| | | | | |
|---|---|---|---|---|
| 3,462,584 | A * | 8/1969 | Guy | F24C 14/02 219/412 |
| 4,927,996 | A * | 5/1990 | Genbauffe | F24C 15/022 126/197 |
| 6,302,098 | B1 * | 10/2001 | Smith | E05B 17/0029 126/197 |
| 6,315,336 | B1 * | 11/2001 | Swartzell | E05B 47/0012 292/201 |
| 6,698,418 | B2 * | 3/2004 | Ramsey | F24C 15/022 126/19 R |
| 7,040,674 | B2 * | 5/2006 | Lomicka | E05B 47/0012 292/201 |
| 7,137,387 | B2 * | 11/2006 | Edwards | F24C 15/022 126/190 |
| 7,185,925 | B2 * | 3/2007 | Courter | F24C 15/022 292/109 |
| 7,726,294 | B2 * | 6/2010 | Collene | F24C 15/022 126/192 |

* cited by examiner

*Primary Examiner* — Carlos Lugo
(74) *Attorney, Agent, or Firm* — Emerson Thomson Bennett, LLC; Roger D. Emerson

(57) ABSTRACT

A latching assembly uses a flat sheet metal chassis with a first and a second electrical switches, an electrical motor driving an eccentric cam, a push rod, a hook, a spring, and a first and a second actuator rods. When the push rod is moved axially by an outside force it opens a circuit connection held closed by the spring on the push rod. This allows current flow to a motor which drives the eccentric cam and pushes an actuator rod to move axially against a hook causing it to move from a first, non-latching position to a second, latching position. The assembly is useful for latching an oven when at high temperature.

17 Claims, 5 Drawing Sheets

ELECTROMECHANICAL ASSEMBLY FOR OVEN DOOR LATCHING

BACKGROUND

This disclosure relates to the field of mechanical controls especially for large appliances such as household cooking ranges and ovens. Such ovens may have a self-cleaning feature wherein high temperature is used to burn-off organic materials left in the oven from cooking spills and residues. In this case, the oven door must be locked during such high-temperature cleaning as a safety measure. The door must not be able to be opened until temperature within the oven is within a safe range. Conventional issues that arise with the electromechanical assemblies now in use on cooking stoves, ranges and ovens include difficulty in connecting multiple wire-harness connectors to their respective socket ports on the assembly, waste of assembly time in the latter activity, electromagnetic interference from motors on or near the assembly causing false signals, and complexity and time requirements of point-to-point wiring. This disclosure defines improvements to such interlocking assemblies; improvements that overcome the above described problems saving assembly time, reducing assembly errors, and improving operational performance as well as other benefits.

BRIEF DESCRIPTION OF THE SEVERAL VIEWS OF THE DRAWING

Like reference symbols in the various drawings indicate like elements.

DETAILED DESCRIPTION

The presently described oven door latching assembly 5 is mounted as a part of an appliance (not shown) such as a cooking stove or oven. It is positioned within the appliance in a position where it is able to safely lock an oven door during high temperature operations such as oven cleaning.

Figure 1:
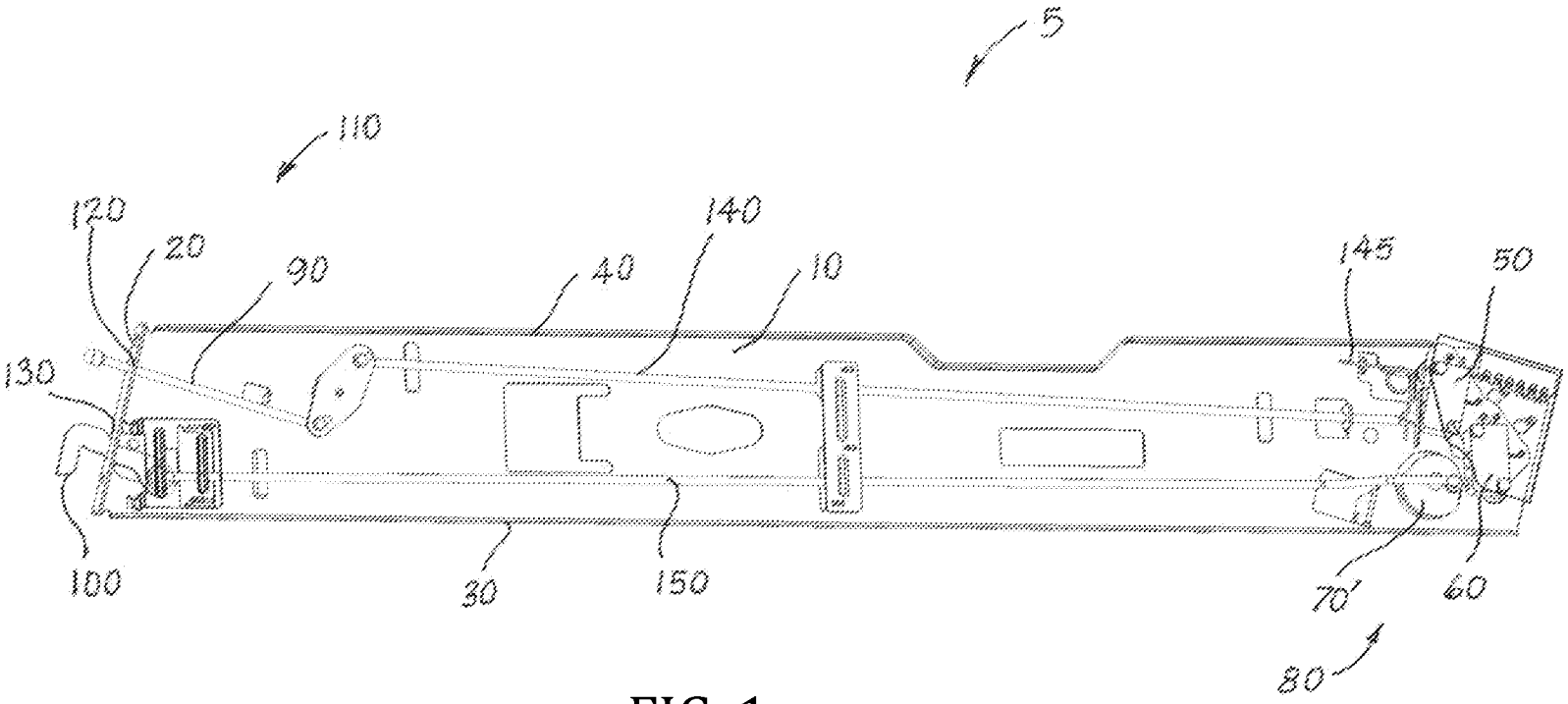
FIG. 1 is an example front perspective view of the presently described apparatus.

As shown in FIG. 1, assembly 5 may be constructed with a rectangular sheet metal chassis 10 which may be an elongated, generally flat part which may have flanges 20, 30, 40 on three sides providing rigidity and other benefits. FIG. 1 shows a front face of chassis 10. Electrical switches and a motor may be fixedly mounted at a proximal end 80 of chassis 10 and a push rod and a hook may be movably mounted at an opposing distal end 110.

Figure 2:
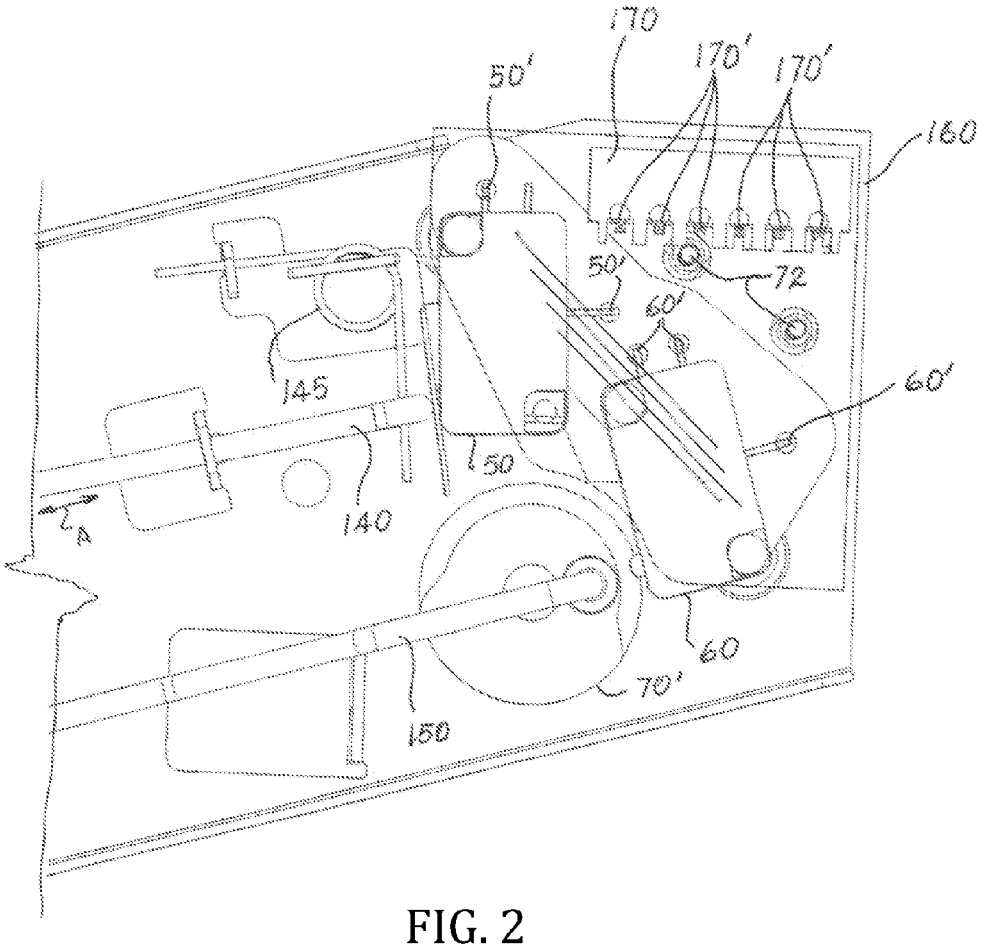
FIG. 2 is a proximal portion taken from FIG. 1.
Figure 3:
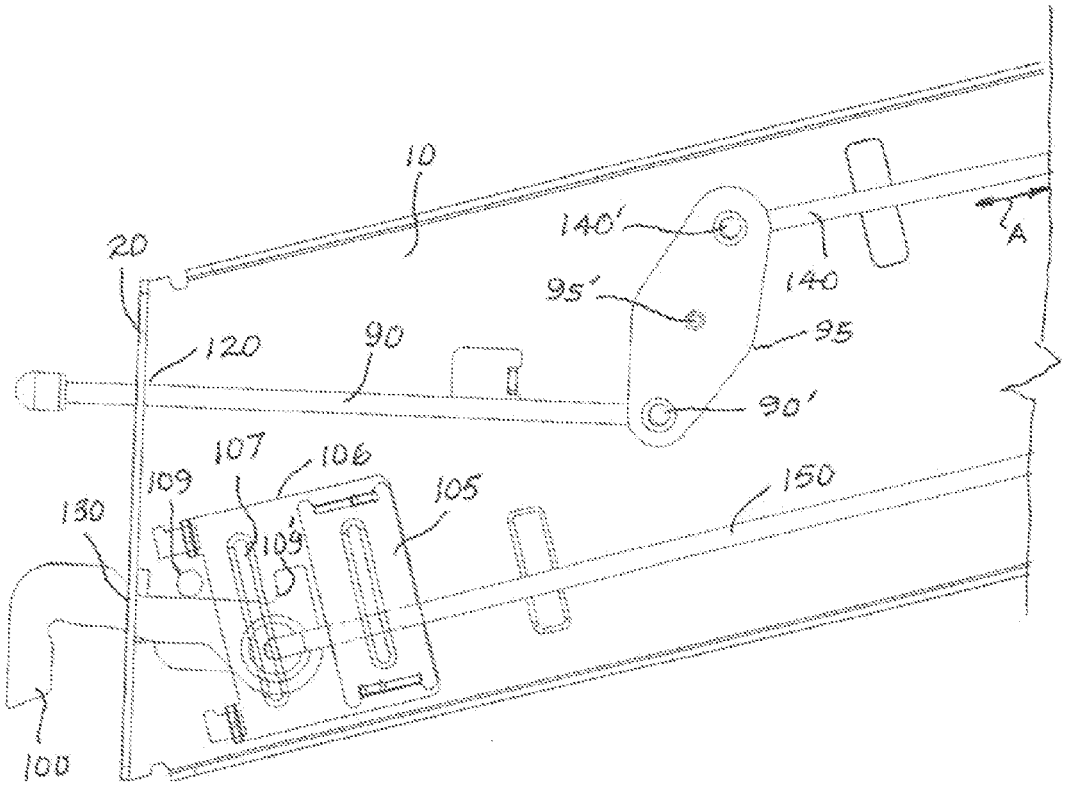
FIG. 3 is a distal portion taken from FIG. 1.

As shown in FIG. 2 electrical switches 50 and 60, and an electrical motor 70 (FIG. 4) may be fixedly mounted to chassis 10 at the proximal end 80. A push rod 90 and a hook 100 may be movably mounted at the distal end 110 and both push rod 90 and hook 100 may extend outwardly from the distal end 110 through penetrations 120 and 130 in flange 20 as shown in FIG. 3. Actuator rods 140 and 150 may be secured on chassis 10 in a manner that enables them to move axially. The actuator rod 140 is secured for axial motion so as to transfer force between push rod 90 and switch 50. The actuator rod 150 is secured for axial motion so as to transfer force between motor 70 and hook 100.

Figure 4:
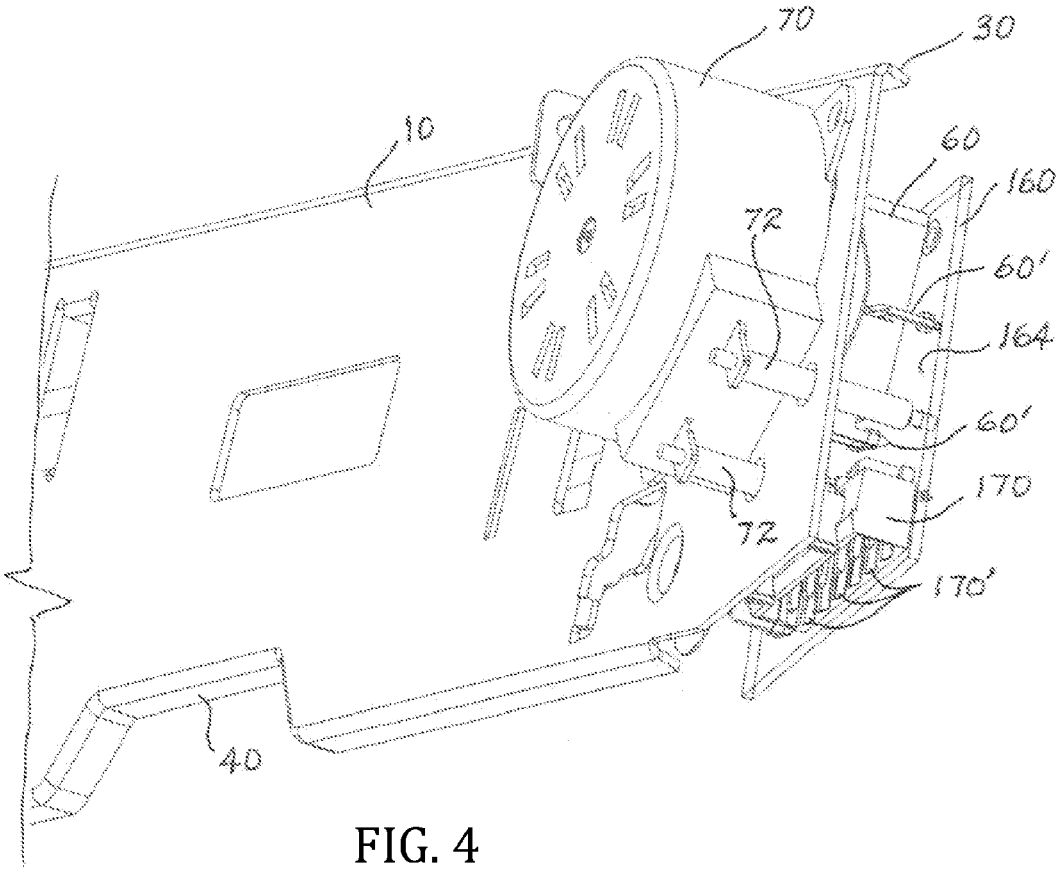
FIG. 4 is a rear perspective view of proximal portion shown in FIG. 2.
Figure 5:
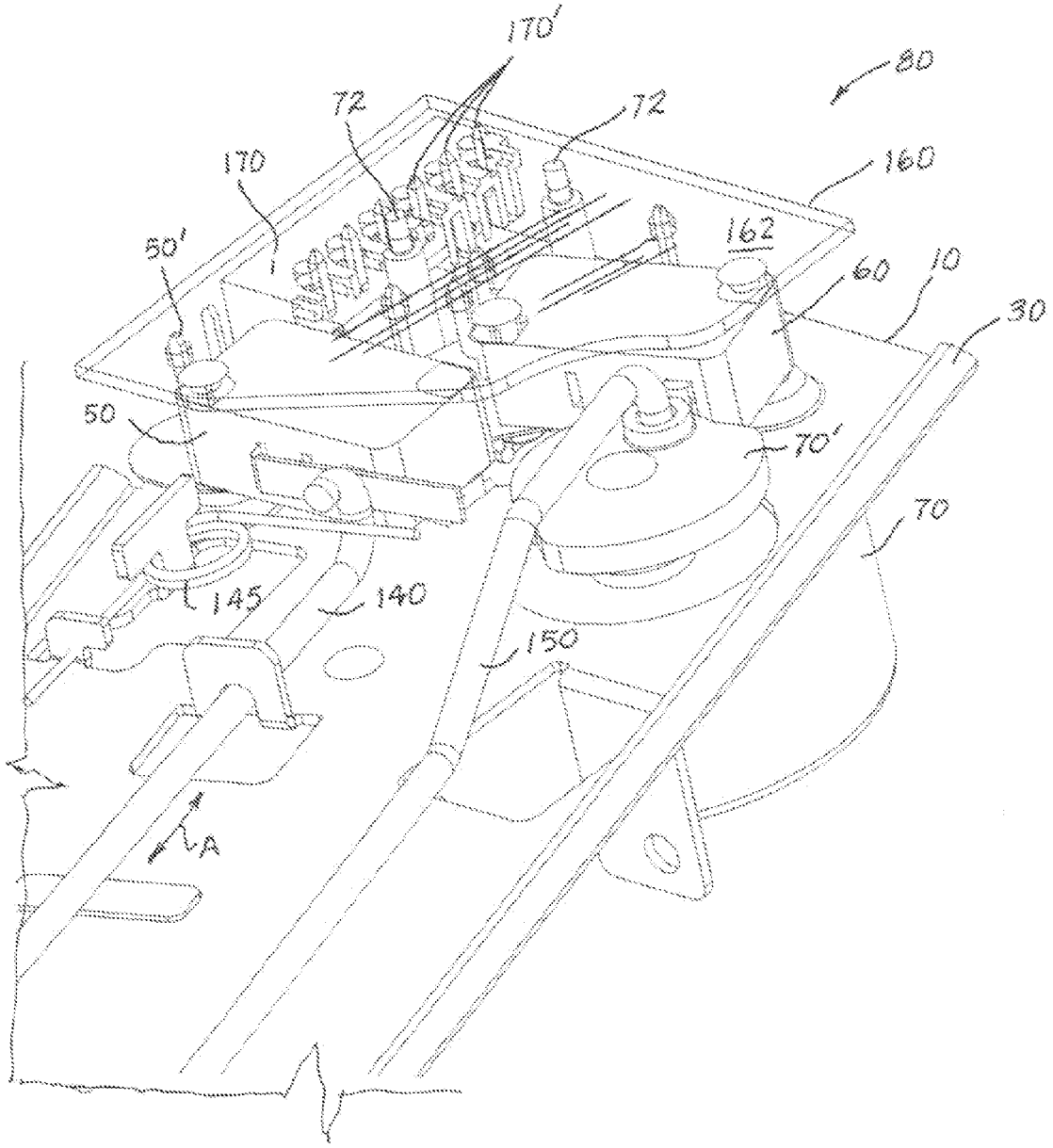
FIG. 5 is a further proximal front perspective view as in FIG. 2.

FIGS. 4 and 5 show that a printed circuit board 160 is mounted on switch 60 above, and spaced apart from, chassis 10, and a connector port 170 may be mounted on the front face of chassis 10. The electrical connector pins 170' of port 170 may extend into, and penetrate through, board 160 as is shown in FIG. 5. Switches 50 and 60 also may have electrical terminals 50' and 60' respectively, which may extend through board 160. Board 160 may carry passive electrical components such as fuses, capacitors, and resistors (not shown). Such a circuit on surface 162 may be subjected to electromagnetic fields and electrical transients induced by switches 50 and 60, and especially by motor 70. The underside 164 of board 160 may be metal coated so as to form a conductive ground plane and electromagnetic shield which may protect against transient electromagnetic fields produced by the operation of switches 50 and 60, and motor 70.

FIG. 3 shows by arrow "A" that actuator rod 140 is able to translate axially. In FIGS. 2 and 5 it is shown that spring 145 presses rod 140 against a lever of switch 50, whereby rod 140 is in a proximal position. Now, moving distally, in FIG. 3, it is shown that actuator rod 140 pivotally engages push rod 90 through rotational link 95 which may rotate about pivotal axle 95' which may be rotationally fixed to chassis 10. Pivot axles 90' and 140' may rotationally fasten push rod 90 and actuator rod 140 respectively to link 95. Therefore, as can be seen that a terminal end of, push rod 90 may be extended distally away from flange 20. Link 95 may function to reverse a directional sense of rod 90 so that when rod 140 moves proximally (to the right in FIG. 3), rod 90 moves distally (to the left in FIG. 3).

FIG. 5 shows that actuator rod 150 may be engaged with eccentric cam 70' which may be rotated by motor 70. With cam 70' in the position shown in FIG. 5, rod 150 is at its proximally terminal location. As shown in FIG. 3, the distal end of rod 150 may engaged slot 107 so that as cam 70' rotates, rod 150 and hook 100 both may move along slot 107. Sheet metal bridge 105 may be positioned over rod 150 preventing it from disengaging from slot 107. As the distal end of rod 150 moves along slot 107 hook 100 extends outward from flange 20 until curve 109' engages peg 109 at which time both hook 100 and rod 150 are in their distally extreme positions whereupon hook 100 may engage a door latch (not shown) thereby securing an oven door in its sealed position. As the oven door is closed, it pushes rod 90 in the proximal direction thereby releasing the lever of switch 50 (electrical open) thereby signaling that the oven door is secured and that it is acceptable to energize motor 70 to cause latching as described above. This sequence of events is triggered when the oven door is closed and a console button is depressed to generate an electrical signal for high temperature cleaning. This signal is transmitted through pins 170' of connector port 170 via a plug on a wire harness (not shown) and then through printed circuit conductive paths on circuit board 160 to energize motor 70 through switch 60.

Assembly 5 is constructed in a manner that improves assembly speed in production by reducing the amount of labor and the number of parts that are required and thereby avoiding assembly errors which are common in the art. Assembly 5 also provides simplified operation as compared with current prior art devices in use. Additionally, the transmission of transient electrical signals are prevented from affecting the electrical circuit on board 160.

Embodiments of the subject apparatus and method have been described herein. Nevertheless, it will be understood that various modifications may be made without departing from the spirit and understanding of this disclosure. Accordingly, other embodiments and approaches are within the scope of the foregoing.

What is claimed is:

1. A latching apparatus having a proximal end and a distal end and movable between a non-latching state and a latching state, the latching apparatus comprising:

a door, a first electrical switch, a second electrical switch, an electrical motor driving an eccentric cam, a push rod having a proximal end and a distal end, a hook, a spring, and a first actuator rod and a second actuator rod having a proximal end and a distal end;

wherein when the latching apparatus is in the non-latching state:

the first actuator rod is in a proximal position wherein:

a. the proximal end of the first actuator rod is engaged with the spring, the spring being in a relaxed state, thereby making contact with the first electrical switch to form a first closed electrical circuit with the first electrical switch, and b. the distal end of the first actuator rod is engaged with the proximal end of the push rod by a pivoting link member, the push rod being in a distal position; and the second actuator rod is in a proximal position wherein:

c. the proximal end of the second actuator rod is engaged with the eccentric cam, the eccentric cam being in contact with but not activated by the second switch, and d. the distal end of the second actuator rod is engaged with the hook, the hook being in a non-latching state; and wherein when the latching apparatus is in the latching state:

the first actuator rod is in a distal position wherein:

a. the door of the apparatus will engage the push rod, so as to move the push rod toward a proximal position and wherein movement of the push rod actuates the first actuator rod to move to a distal position causing the proximal end of the first actuator rod, engaged with the spring, to break contact with the first electrical switch to form an electrical open and b. the distal end of the first actuator rod is engaged with the proximal end of the push rod by a pivoting link member in a manner which allows the push rod to be in a proximal position; and the second actuator rod is in a distal position wherein:

c. the proximal end of the second actuator rod, engaged with the eccentric cam, is in contact with and is activated by the second switch to axially translate the second actuator rod to the distal position, and d. the distal end of the second actuator rod, engaged with the hook, moves the hook to a latching position wherein, when the pushrod is moved towards the proximal end of the latching apparatus, the first electrical circuit formed by the first switch is broken thereby causing rotation of the electric motor and thereby forming a second electrical circuit with the second switch, causing the eccentric cam to rotate and causing a latching action by the hook wherein the first electrical switch, the second electrical switch, and the electrical motor are electrically connected to each other through a printed circuit board which receives electrical power through a connector port via a plug on a wire harness wherein power is transmitted through electrical connector pins on the connector port, further wherein the electrical connector pins of the connector port extend into and penetrate through the printed circuit board.

2. The latching apparatus of claim 1, wherein the latching apparatus is constructed with a rectangular sheet metal chassis.

3. The latching apparatus of claim 2, wherein the rectangular sheet metal chassis is an elongated, generally flat part having flanges on three sides to provide rigidity.

4. The latching apparatus of claim 3, wherein the first and second electrical switches and the electrical motor are fixedly mounted at a proximal end of the chassis and the push rod and hook are movably mounted at a distal end of the chassis.

5. The latching apparatus of claim 1, wherein the spring presses the first actuator rod against a lever of the first electrical switch when the first actuator rod is in the proximal position.

6. The latching apparatus of claim 5, wherein the first actuator rod pivotally engages the push rod through a rotational link which rotates about a pivotal axle which is rotationally fixed to the chassis.

7. The latching apparatus of claim 6, wherein the push rod and the first actuator rod are rotationally fastened to the rotational link through separate pivotal axles.

8. The latching apparatus of claim 7, wherein the rotational link reverses a directional sense of the push rod so that when the first actuator rod moves to the proximal position, the push rod moves to the distal position.

9. The latching apparatus of claim 1, wherein the distal end of the second actuator rod engages a slot so that as the eccentric cam rotates, the second actuator rod and the hook may both move along the slot.

10. The latching apparatus of claim 9, wherein a sheet metal bridge is positioned over the second actuator rod to prevent it from disengaging from the slot.

11. The latching apparatus of claim 10, wherein the hook engages a peg when in its distally extreme position.

12. A latching apparatus having a proximal end and a distal end and movable between a non-latching state and a latching state, the latching apparatus comprising:

a first electrical switch, a second electrical switch, an electrical motor driving an eccentric cam, a push rod having a proximal end and a distal end, a hook, a spring, and a first actuator rod and a second actuator rod having a proximal end and a distal end;

wherein when the latching apparatus is in the non-latching state:

the first actuator rod is in a proximal position wherein:

a. the proximal end of the first actuator rod is engaged with the spring, the spring being in a relaxed state, thereby making contact with the first electrical switch to form a first closed electrical circuit with the first electrical switch, and b. the distal end of the first actuator rod is engaged with the proximal end of the push rod by a pivoting link member, the push rod being in a distal position; and the second actuator rod is in a proximal position wherein:

c. the proximal end of the second actuator rod is engaged with the eccentric cam, the eccentric cam being in contact with but not activated by the second switch, and d. the distal end of the second actuator rod is engaged with the hook, the hook being in a non-latching state; and wherein when the latching apparatus is in the latching state:

the first actuator rod is in a distal position wherein:

a. the door of the apparatus will engage the push rod, so as to move the push rod toward a proximal position and wherein movement of the push rod actuates the first actuator rod to move to a distal position causing the proximal end of the first actuator rod, engaged with the spring, to break contact with the first electrical switch to form an electrical open and b. the distal end of the first actuator rod is engaged with the proximal end of the push rod by a pivoting link member in a manner which allows the push rod to be in a proximal position; and the second actuator rod is in a distal position wherein:

c. the proximal end of the second actuator rod, engaged with the eccentric cam, is in contact with and is activated by the second switch to axially translate the second actuator rod to the distal position, and d. the distal end of the second actuator rod, engaged with the hook, moves the hook to a latching position, wherein when the pushrod is moved towards the proximal end of the latching apparatus, the first electrical circuit formed by the first switch is broken, thereby forming a second electrical circuit with the second switch which energizes and causes rotation of the electric motor which causes the eccentric cam to rotate to cause a latching action by the hook wherein electrical power to the first electrical switch, the second electrical switch and the electrical motor is supplied through a single point power connection established by connecting a plug to a receptacle within a connector port.

13. The latching apparatus of claim 12, wherein the receptacle of the connector port comprises connector pins.

14. The latching apparatus of claim 13, wherein the connector pins are oriented within the receptacle in an asymmetrical manner to require a polarized connection between the plug and the connector port which requires the plug to be oriented to a specific side to engage the connector port.

15. The latching apparatus of claim 14, wherein the receptacle of the connector port comprises a first horizontal row and a second horizontal row of connector pins, wherein the first horizontal row and the second horizontal row of connector pins form an asymmetrical pattern of connector pins within the receptacle.

16. The latching apparatus of claim 15, wherein the receptacle of the connector port comprises six (6) connector pins within the first horizontal row and six (6) connector pins within the second horizontal row.

17. The latching apparatus of claim 16, wherein the first electrical switch, the second electrical switch and the electrical motor are electrically connected to each other through a printed circuit board which receives electrical power through the connector port and wherein the connector pins of the connector port extend into and penetrate through the printed circuit board.

* * * * *